US011510531B2

(12) United States Patent
Lee

(10) Patent No.: US 11,510,531 B2
(45) Date of Patent: Nov. 29, 2022

(54) CASE OF PORTABLE COMPRESSED TISSUE

(71) Applicant: CLEANZONE CO., LTD., Pocheon-si (KR)

(72) Inventor: Wan Gu Lee, Seoul (KR)

(73) Assignee: CLEANZONE CO., LTD., Pocheon-si (KR)

( * ) Notice: Subject to any disclaimer, the term of this patent is extended or adjusted under 35 U.S.C. 154(b) by 306 days.

(21) Appl. No.: 16/943,452

(22) Filed: Jul. 30, 2020

(65) Prior Publication Data

US 2021/0330144 A1 Oct. 28, 2021

(30) Foreign Application Priority Data

Apr. 27, 2020 (KR) ..... 10-2020-0051038

(51) Int. Cl.
*B65D 83/08* (2006.01)
*A47K 10/42* (2006.01)
*A47K 10/32* (2006.01)

(52) U.S. Cl.
CPC ..... *A47K 10/421* (2013.01); *B65D 83/08* (2013.01); *A47K 2010/3273* (2013.01); *B65D 2583/0468* (2013.01)

(58) Field of Classification Search
CPC ..... A47K 10/421
USPC ..... 221/33–63
See application file for complete search history.

(56) References Cited

U.S. PATENT DOCUMENTS 7,648,046 B2 * 1/2010 Sosalla ..... F28D 20/023 221/36
2007/0278242 A1 * 12/2007 Amundson ..... F28D 20/023 221/63
2008/0289993 A1 * 11/2008 Flannery ..... A47K 5/12 221/33
2015/0289731 A1 * 10/2015 Lee ..... A47K 10/426 221/45

FOREIGN PATENT DOCUMENTS

KR 10-1789473 B1 10/2017
KR 10-1984459 B1 5/2019

* cited by examiner

*Primary Examiner* — Gene O Crawford
*Assistant Examiner* — Ayodeji T Ojofeitimi
(74) *Attorney, Agent, or Firm* — Novick, Kim & Lee, PLLC; Jae Youn Kim

(57) ABSTRACT

Provided is a case of portable compressed tissue, and more specifically, a compressed tissue is immersed by adjusting the compressed tissue according to a water level of a stored solution, and thus, a case for storing the compressed tissue and a solution allows easy and convenient carrying and storage to a user, and also, the compressed tissue is immersed in an appropriate amount of a solution according to a water level of the remaining solution by an immersion portion provided in a compressed tissue case, and thus, it is possible to conveniently use the compressed tissue from the outside, and to efficiently use the solution.

2 Claims, 4 Drawing Sheets

CASE OF PORTABLE COMPRESSED TISSUE

CROSS-REFERENCE TO RELATED APPLICATION

This application claims priority to Korean Patent Application No. 10-2020-0051038, filed on Apr. 27, 2020, in the Korean Intellectual Property Office, the disclosure of which is incorporated herein in its entirety by reference.

BACKGROUND

1. Field

The inventive concept relates to a case of portable compressed tissue, and particularly, a compressed tissue is immersed by adjusting the compressed tissue according to a water level of a stored solution, and thus, a case for storing the compressed tissue and a solution allows easy and convenient carrying and storage to a user, and also, the compressed tissue is immersed in an appropriate amount of solution according to a water level of the remaining solution by an immersion portion provided in a compressed tissue case, and thus, it is possible to conveniently use the compressed tissue from the outside, and to efficiently use the solution.

2. Description of the Related Art

In general, tissues are articles used for hygiene, and are representative hygiene products that are mainly made of a material such as paper or non-woven fabric and used as dry tissues and wet tissues, or compressed tissues for household or portable articles.

The above-described dry tissues are restrictive to be used for cleaning and sanitation of children when going out in the open air, etc., and need for wet tissues to be used simply before eating in restaurants and so on increases.

The wet tissues are manufactured in unit packaging for portable or commercial use, and the disposable wet tissues are found to be up to 880 times higher in general bacteria in restaurant wet tissues than the allowable standard as a result of a survey on safety of commercial hygiene products at Korea Consumer Resources, and media reports a controversy over harmfulness of the wet tissues, and thus, consumers have a lot of negative aspects to hygiene.

On the other hand, coin tissues, that is, compressed tissues are stored as dry compressed tissues, and when immersed in water as needed, the compressed tissues absorb water to expand, thus, being used as wet tissues.

a solution such as water is required to use the compressed tissues, and thus, a portable case to carry is developed, and in relation to a case of portable compressed tissue, the present applicant, Clean Zone, applied for many patents related to the case of portable compressed tissue and received many patents.

As a technical document of related art relating to a case of portable compressed tissue, there is disclosed Korean Patent Registration No. 10-1789473 entitled "PORTABLE COMPRESSED TISSUE DISPENSER", and the disclosure of the related art is manufactured in a compact size suitable for carrying, a separate water chamber for storing fresh water is provided to facilitate immersion of compressed tissues in addition to multiple compressed tissues included therein.

As another technical document of related art, Korean Patent Registration No. 10-1984459 entitled "CASE FOR COIN TISSUE" includes an upper opening through which a coin tissue (hereinafter, referred to as a compressed tissue) is slidably input and output, a drawer in which multiple compressed tissues are seated in one or more rows, and a wet tissue generation portion that stores water (hereinafter, referred to as a solution) outside a case, and thus, a user may go out by carrying a compressed tissue.

However, according to an immersion method using an immersion socket of the case of portable compressed tissue of the related art, an immersion effect is reduced due to leakage or loss of a solution during an immersion process, and a failure rate of products increases.

In addition, there is no separate means for selectively absorbing a solution in a compressed tissue according to the remaining amount of the solution when the compressed tissue is immersed in the solution, and thus, there is a problem that it is inconvenient to use.

SUMMARY

According to the inventive concept, a compressed tissue is immersed by adjusting the compressed tissue according to a water level of a stored solution, and thus, a case for storing the compressed tissue and a solution allows easy and convenient carrying and storage to a user, and also, the compressed tissue is immersed in an appropriate amount of a solution according to a water level of the remaining solution by an immersion portion provided in a compressed tissue case, and thus, it is possible to conveniently use the compressed tissue from the outside, and to efficiently use the solution.

Additional aspects will be set forth in part in the description which follows and, in part, will be apparent from the description, or may be learned by practice of the presented embodiments of the disclosure.

The inventive concept provides a case of portable compressed tissue including a case body that includes an accommodation portion in which multiple compressed tissues are stacked and stored, a solution storage portion that stores and keeps a solution for immersing the compressed tissues, and a fixed socket portion coupled to the accommodation portion to block the accommodation portion from the outside; and an immersion portion for immersing the compressed tissues, wherein the solution storage portion of the case body includes a protruding portion protruding in a longitudinal direction on one side, and a hooking jaw provided in an upper portion of an inner surface, wherein the fixed socket portion includes a fixed hole for coupling with the case body, a fixed protrusion that protrudes from a lower surface of the case body and inserted into the fixed hole, and an insertion hole that is inserted into and supported to the accommodation portion, and wherein the immersion portion includes an immersion member that is provided on an upper side of the solution storage portion so that the immersion member which received the compressed tissue moves, a cover for covering an upper portion, and a packing coupled to an inside of the cover to block leakage of an internal solution.

In addition, the immersion member of the immersion portion may include multiple through-holes formed at an inside lower portion thereof so that an accommodated solution of the solution storage portion flows through the holes, and a recess portion that is coupled to the protruding portion to be guided during a vertical movement.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
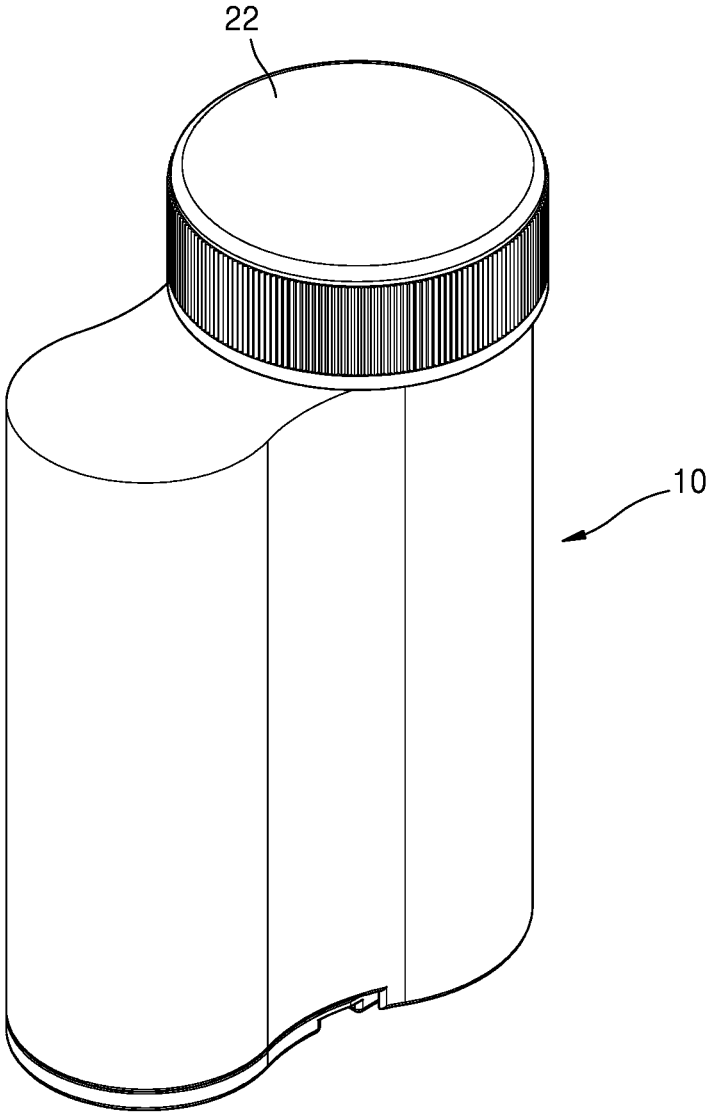
FIG. 1 is a perspective view illustrating a case of portable compressed tissue according to the inventive concept.
Figure 2:
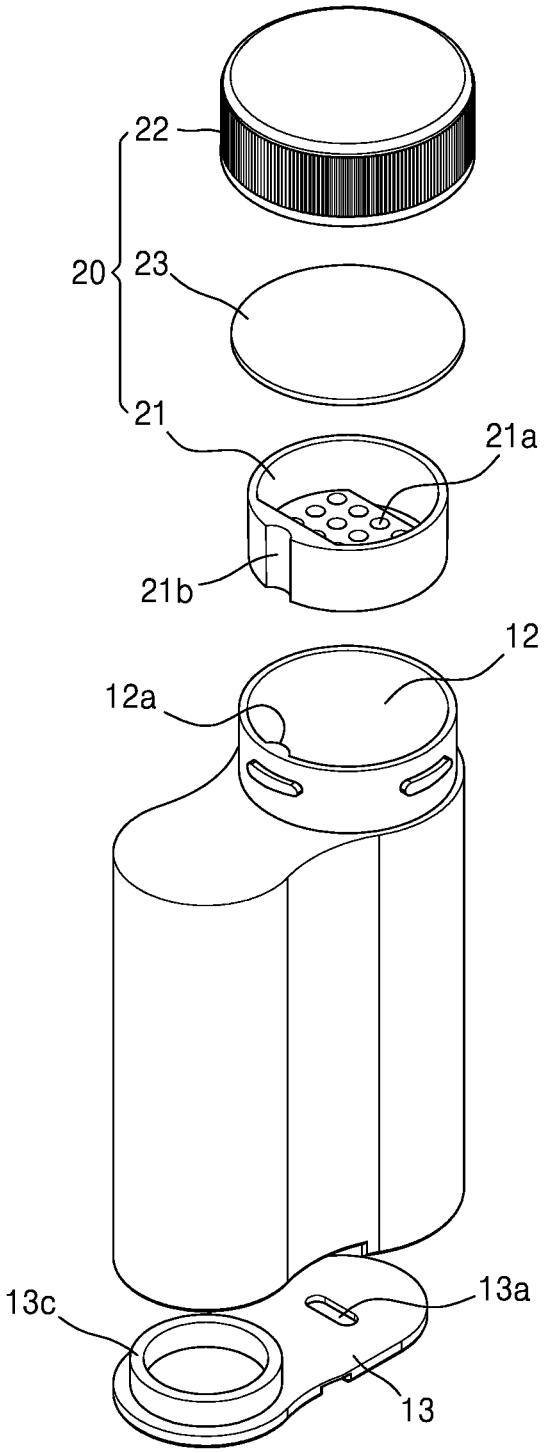
FIG. 2 is a perspective view illustrating a separation state according to the inventive concept.
Figure 3:
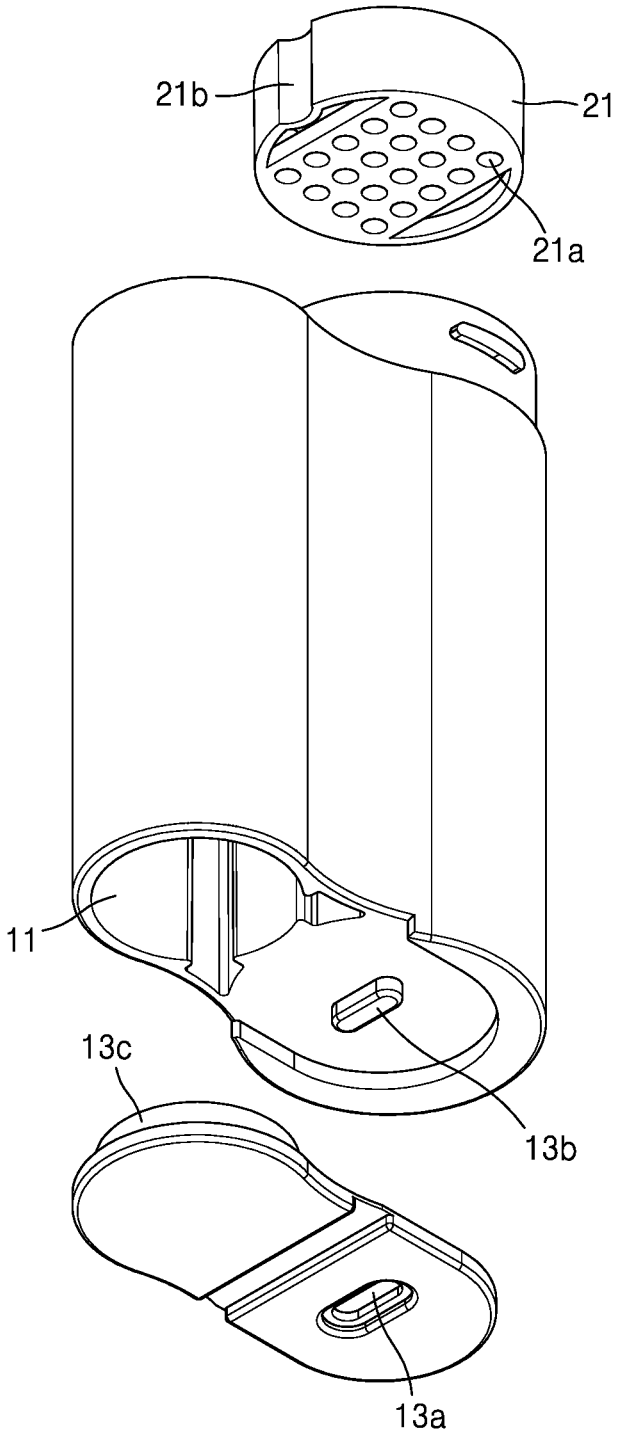
FIG. 3 is a perspective view illustrating a rear side according to the inventive concept.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments of the inventive concept will be described in detail with reference to the accompanying drawings so that those skilled in the art to which the inventive concept belongs may easily implement.

However, the inventive concept may be implemented in many different forms and is not limited to the embodiments described below. In addition, in order to clearly describe the inventive concept in the drawings, parts irrelevant to the description are omitted, and like reference numerals are attached to like parts throughout the specification.

The configuration and effect according to the inventive concept will be described in detail with reference to the accompanying drawings.

As illustrated in FIGS. 1 to 4, the inventive concept includes a case body 10 for accommodating multiple compressed tissues and an immersion solution such as water, and an immersion portion 20 for immersing the compressed tissues.

The case body 10 includes an accommodation portion 11 in which multiple compressed tissues are stacked and stored, a solution storage portion 12 that stores and keeps a solution for immersing the compressed tissues, and a fixed socket portion 13 coupled to the accommodation portion 11 to block the accommodation portion 11 from the outside.

The accommodation portion 11 is formed in a cylindrical shape so that the compressed tissues are introduced.

The solution storage portion 12 includes a protruding portion 12*a* protruding in a longitudinal direction on one side, and a hooking jaw 12*b* provided in an upper portion of an inner surface.

The fixed socket portion 13 includes a fixed hole 13*a* for coupling with the case body 10, a fixed protrusion 13*b* that protrudes from a lower surface of the case body 10 and inserted into and coupled to the fixed hole 13*a* to fasten therewith, and an insertion portion 13*c* that is formed to couple the fixed socket portion 13 to the case body 10 and protrudes to be inserted into and supported to the accommodation portion 11 and supported thereto.

The immersion portion 20 includes an immersion member 21 that is provided on an upper side of the solution storage portion 12 in order to introduce and move the compressed tissues, a cover 22 for covering an upper portion of the solution storage portion 12, and a packing 23 fastened with the inside of the cover 22 to block leakage of a solution.

The immersion member 21 includes multiple through-holes 21*a* formed at an inside lower portion of the immersion member 21 so that the accommodated solution of the solution storage portion 12 flows through the holes 21*a*, and a recess portion 21*b* that is coupled to the protruding portion 12*a* to be guided during a vertical movement.

A reference numeral 1 not described is a solution such as water.

Hereinafter, actions and effects according to the configuration of the inventive concept will be described in detail with reference to the accompanying drawings.

As illustrated in FIGS. 1 to 4, when the fixed protrusion 13*b* is released from the fixed hole 13*a* in an inserted and fastened state, the insertion portion 13*c* inserted into and supported to the accommodation portion 11 is also released therefrom, and thereby, the fixed socket portion 13 is separated from the case body 10, and thus, it is possible to store the compressed tissues in the accommodation portion 11 of the case body 10 or to take out the compressed tissue when necessary.

Then, when the cover 22 of the case body 10 is opened and the compressed tissue is introduced into the immersion member 21 of the immersion portion 20, the solution 1 of the solution storage portion 12 is absorbed by the compressed tissue through the through-hole 21*a* formed in a lower surface of the immersion member 21, and thus, a wet tissue may be used.

When a water level of the solution 1 in the solution storage portion 12 goes down, the immersion member 21 can be pressed to descend downward. Since the recess portion 21*b* of the immersion member 21—is inserted and coupled to the protruding portion 12*a*, the immersion member 21 is guided by the protruding portion 12*a* to descend to a stored water level of the solution 1, and thereby, the compressed tissue introduced in the immersion member 21 may be immersed in the solution 1 to be used as a wet tissue.

Figure 4:
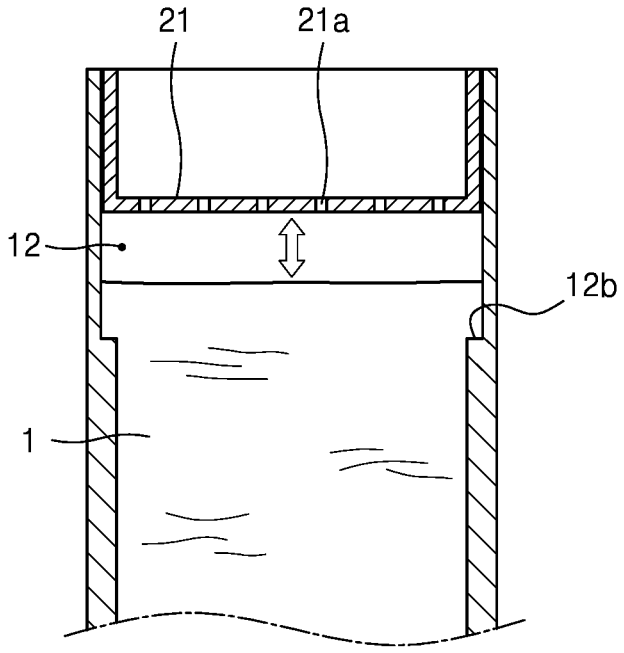
FIG. 4 is a cross-sectional view illustrating a use state according to the inventive concept.

As illustrated in FIG. 4, the immersion member 21 moves up and down in the immersion portion 20 in a state of being in close contact therewith, and thus, the immersion member 21 may be fixed to a required height and moved down to a certain height by the hooking jaw 12*b* provided on the inner surface of the solution storage portion 12, and thus, when the remaining amount of the solution stored in the solution storage portion 12 is small, the case body 10 is turned over with the cover 22 closed, or the compressed tissue is placed in the cover 22 and a solution is injected into the cover 22 to use the compressed tissue in which the solution is absorbed as a wet tissue.

In addition, leakage of the solution stored and kept in the solution storage portion 12 is blocked by the packing 23 coupled to the cover 22, and thus, it is possible to prevent contamination due to the leakage of the solution due to carrying. In addition, coupling and separation of the fixed protrusion 13*b* and the fixed hole 13*a* of the fixed socket portion 13 are easily performed, and thus, it is convenient to store and withdraw the compressed tissue, and it is possible to easy cleaning and hygienic management due to a structure that is easy to separate and combine.

As described above, according to the inventive concept, a compressed tissue is immersed by adjusting the compressed tissue according to a water level of a stored solution, and thus, a case for storing the compressed tissue and a solution allows easy and convenient carrying and storage to a user, and also, the compressed tissue is immersed in an appropriate amount of a solution according to a water level of the remaining solution by an immersion portion provided in a compressed tissue case, and thus, it is possible to conveniently use the compressed tissue from the outside, and to efficiently use the solution.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A case of portable compressed tissue comprising:

a case body including an accommodation portion in which multiple compressed tissues are stacked and stored, a solution storage portion that stores and keeps a solution for immersing the compressed tissues, and a fixed socket portion coupled to the accommodation portion to block the accommodation portion from the outside; and an immersion portion for immersing the compressed tissues, wherein the solution storage portion of the case body includes a protruding portion protruding in a longitudinal direction on one side, and a hooking jaw provided in an upper portion of an inner surface, wherein the fixed socket portion includes a fixed hole for coupling with the case body, a fixed protrusion that protrudes from a lower surface of the case body and inserted into the fixed hole, and an insertion portion that is inserted into and supported to the accommodation portion, and wherein the immersion portion includes an immersion member that is provided on an upper side of the solution storage portion so that the immersion member received the compressed tissues moves, a cover for covering an upper portion, and a packing coupled to an inside of the cover to block leakage of an internal solution.

2. The case of portable compressed tissue of claim 1, wherein the immersion member of the immersion portion includes multiple through-holes formed at an inside lower portion thereof so that an accommodated solution of the solution storage portion flows through the holes, and a recess portion that is coupled to the protruding portion to be guided during a vertical movement.

* * * * *